US012508465B1

(12) United States Patent
Guo

(10) Patent No.: US 12,508,465 B1
(45) Date of Patent: Dec. 30, 2025

(54) LEG EXERCISE DEVICE WITH EMERGENCY BRAKING

(71) Applicant: Jiangsu Qili Health Technology Co., Ltd., Jiangsu (CN)

(72) Inventor: Leigang Guo, Hebei (CN)

(73) Assignee: Jiangsu Qili Health Technology Co., Ltd., Jiangsu (CN)

( * ) Notice: Subject to any disclaimer, the term of this patent is extended or adjusted under 35 U.S.C. 154(b) by 0 days.

(21) Appl. No.: 19/077,905

(22) Filed: Mar. 12, 2025

(51) Int. Cl.
*A63B 21/00* (2006.01)
*A63B 21/078* (2006.01)
*A63B 23/04* (2006.01)

(52) U.S. Cl.
CPC ..... *A63B 21/0783* (2015.10); *A63B 21/4034* (2015.10); *A63B 2023/0411* (2013.01)

(58) Field of Classification Search
CPC ..... A63B 21/0783; A63B 21/4034; A63B 2023/0411; A63B 23/0405; A63B 21/0626; A63B 21/078; A63B 21/4045; A63B 2071/0072; A63B 21/4033; A63B 23/03525; A63B 2208/0204; A63B 2208/0233; A63B 2071/0063; A63B 21/4029; A63B 2208/0223; A63B 21/062; A63B 21/4031; Y10T 403/29; Y10T 403/291; Y10T 403/293; Y10T 403/295; Y10T 403/297; Y10T 403/30; Y10T 403/32254; Y10T 403/33; Y10T 403/335; Y10T 403/46; Y10T 403/59; Y10T 403/591; Y10T 403/597; Y10T 403/598; Y10T 403/60; Y10T 403/70; Y10T 403/7117; Y10T 403/75
See application file for complete search history.

(56) References Cited

U.S. PATENT DOCUMENTS 4,316,608 A * 2/1982 Lundberg ..... A63B 21/0628 482/142
4,535,985 A * 8/1985 Mask ..... A63B 21/4029 482/138
4,549,734 A * 10/1985 Hibler, Jr. ..... A63B 21/4045 482/135

(Continued)

FOREIGN PATENT DOCUMENTS

KR 20220000325 A * 1/2022
KR 20230111431 A * 7/2023

OTHER PUBLICATIONS

Translation of KR-20220000325-A (Year: 2022).*
Translation of KR-20230111431-A (Year: 2023).*

*Primary Examiner* — Megan Anderson
*Assistant Examiner* — Catrina A Letterman
(74) *Attorney, Agent, or Firm* — Hawaii Patent Services; Nathaniel K. Fedde; Kenton N. Fedde

(57) ABSTRACT

A leg exercise device with emergency braking has a rack and a moving mechanism. The rack is equipped with guide rails, and the moving mechanism is slidable back and forth along the guide rails. The moving mechanism comprises a sliding seat, which is slidably connected to the guide rails and is slidable along the guide rails. The rack is further provided with a braking mechanism located on one side of the sliding seat. The braking mechanism comprises a braking component that is movable towards the sliding seat, and the braking component extends along the sliding direction of the sliding seat.

18 Claims, 8 Drawing Sheets

(56) References Cited

U.S. PATENT DOCUMENTS

| | | | | |
|---|---|---|---|---|
| 5,827,154 | A * | 10/1998 | Gill | A63B 21/0628 482/135 |
| 10,350,127 | B2 * | 7/2019 | Kelly | A63B 23/04 |
| 2004/0023760 | A1 * | 2/2004 | Cockrill, Jr. | A63B 23/0405 482/93 |
| 2023/0405386 | A1 * | 12/2023 | Yoo | A63B 23/0405 |
| 2024/0226653 | A1 * | 7/2024 | Contessa | A63B 23/0405 |
| 2025/0135264 | A1 * | 5/2025 | Andreassen | A63B 21/4029 |

* cited by examiner

LEG EXERCISE DEVICE WITH EMERGENCY BRAKING

TECHNICAL FIELD

The present disclosure relates to the technical field of fitness equipment, particularly to a leg exercise device with emergency braking.

BACKGROUND

The supine leg press machine, also known as the leg push machine or leg press, is one of the common strength training equipment in gyms, mainly used to exercise the lower limb muscles, especially the quadriceps on the front of the thighs, while also strengthening the gluteus maximus, hamstrings, calf muscles, etc. When using the leg press machine, the user needs to lie on the inclined seat, place his feet on the platform, push the platform to extend his feet forward, and then slowly retract them, repeating this movement.

During the use of the traditional leg press machine, if an emergency brake is needed (such as when cramps or other unexpected situations occur during the leg extension and contraction process), it is not convenient to perform the braking operation. Generally, the safety brake shifting rod is placed at the top of the entire leg press machine and controlled by a single handle. However, when cramps or other unexpected situations occur during the leg extension and contraction process, it is difficult for the user to promptly pull the handle located above and behind the head for emergency braking. Another safety braking device installed on both sides of the leg press machine can perform emergency braking in time, but this safety braking mechanism is cumbersome to operate and occupies a large amount of space.

Therefore, there is a need to propose a new type of supine leg press machine, which features simple and convenient brake operation, a simple and compact structure, and a small footprint.

SUMMARY

The present disclosure provides a leg exercise device with emergency braking to solve the problems mentioned in the background technology.

To achieve the above-mentioned object of the present disclosure, the following technical solutions are adopted:

A leg exercise device with emergency braking includes a rack and a moving mechanism, wherein the rack is equipped with guide rails, and the moving mechanism is slidable back and forth along the guide rails; and the moving mechanism comprises a sliding seat, which is slidably connected to the guide rails and is slidable along the guide rails; and the rack is further provided with a braking mechanism located on one side of the sliding seat, wherein the braking mechanism comprises a braking component that is movable towards the sliding seat, and the braking component extends along a sliding direction of the sliding seat; and the braking component is equipped with a first braking part, and the sliding seat is equipped with a second braking part that cooperates with the first braking part; and when the braking component moves towards the sliding seat, the first braking part locks with the second braking part, restricting sliding of the sliding seat.

The present disclosure further provides a leg exercise device with emergency braking, including a rack and a moving mechanism, wherein the rack is equipped with guide rails, and the moving mechanism is slidable back and forth along the guide rails; and the moving mechanism comprises a sliding seat, which is slidably connected to the guide rails and is slidable along the guide rails; and the rack is further provided with a braking mechanism located on one side of the sliding seat, and the braking mechanism comprises a braking component and rockers; and the braking component extends along a sliding direction of the sliding seat, and the rockers are pivotally connected between the rack and the braking component, allowing the rockers to swing between the braking component and the rack; and when the rockers swing, the braking component moves closer to or away from the sliding seat; and the braking component and the sliding seat are respectively equipped with a first braking part and a second braking part; and when the braking component moves towards the sliding seat, the first braking part and the second braking part lock together, restricting sliding of the sliding seat.

The present disclosure further provides a leg exercise device with emergency braking, including a rack and a moving mechanism, wherein the rack is equipped with guide rails, and the moving mechanism is slidable back and forth along the guide rails; and the moving mechanism comprises a sliding seat, which is slidably connected to the guide rails and is slidable along the guide rails; and the rack is further provided with a braking mechanism located on one side of the sliding seat, wherein the braking mechanism comprises a braking component that is movable towards the sliding seat, and the braking component extends along a sliding direction of the sliding seat; and the sliding seat and the braking component are respectively provided with a first braking part and a second braking part; and the braking mechanism further comprises a toggle member, and the toggle member is toggled to drive the braking component to move towards the sliding seat; and when the braking component moves towards the sliding seat, the first braking part and the second braking part lock together, restricting sliding of the sliding seat.

BRIEF DESCRIPTION OF DRAWINGS

The drawings, which constitute part of the specification of this application, are provided to further explain the present disclosure. The illustrative embodiments and the description thereof are used to explain the present disclosure and do not constitute an improper limitation of the present disclosure. In the drawings.

Figure 1:
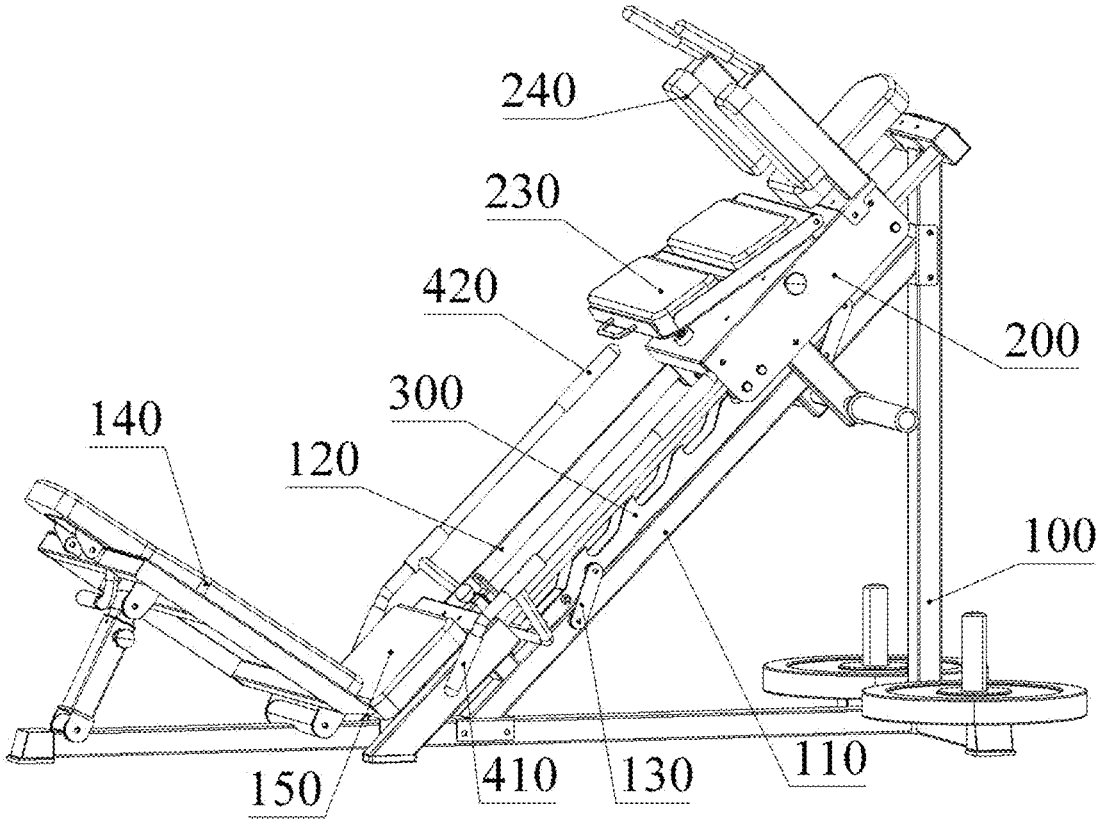
FIG. 1 is a schematic structural diagram of the present disclosure.

Reference signs: Rack (100); Support rod (110); Guide rail (120); Rocker (130); First backrest (140); Seat cushion (150); Sliding seat (200); Pulley set (210); Crossbar (220); Second backrest (230); Lifting arm (240); Braking component (300); Serrated groove (310); Concave surface (311); Flat surface (312); Connecting rod (400), Extended end (401); First shifting rod (410); Second shifting rod (420).

DESCRIPTION OF EMBODIMENTS

The technical solution in the embodiment of the present disclosure will be clearly and completely described below with reference to the drawings. Obviously, the described embodiment is part of, rather than all of the embodiments of the present disclosure. The following description of at least one exemplary embodiment is illustrative in nature and is in no way intended to limit the present disclosure, its application or uses. Based on the embodiments in the present disclosure, all other embodiments obtained by those skilled in the art without creative work belong to the scope of protection of the present disclosure.

It should be noted that the terminology used here is only for describing specific embodiments, and is not intended to limit exemplary embodiments according to the present application. As used herein, the singular form is also intended to include the plural form unless the context clearly indicates otherwise. Furthermore, it should be appreciated that when the terms "comprising" and/or "including" are used in this specification, they specify the presence of features, steps, operations, devices, components and/or combinations thereof.

Unless otherwise specified, the relative arrangement of components and steps, numerical expressions and numerical values set forth in these embodiments do not limit the scope of the present disclosure. At the same time, it should be appreciated that for the convenience of description, the dimensions of various parts shown in the drawings are not drawn according to the actual scale relationship. Techniques, methods and equipment known to those skilled in the art may not be discussed in detail, but in appropriate cases, they should be regarded as part of the authorization specification. In all the examples shown and discussed herein, any specific values should be interpreted as illustrative, and not as limiting. Therefore, other examples of exemplary embodiments may have different values. It should be noted that similar numbers and letters indicate similar items in the following drawings, therefore once an item is defined in one drawing, it does not need to be further discussed in subsequent drawings.

As shown in FIGS. 1 to 7, the present disclosure discloses a leg exercise device with emergency braking, which includes a rack 100 and a moving mechanism. The rack 100 is equipped with guide rails 120, and the moving mechanism is slidable back and forth along the guide rails 120. The moving mechanism includes a sliding seat 200, which is slidably connected to the guide rails 120 and is slidable along the guide rails. The rack 100 is further provided with a braking mechanism located on one side of the sliding seat 200. The braking mechanism includes a braking component 300 that is movable towards the sliding seat 200, and the braking component 300 extends along the sliding direction of the sliding seat 200. The braking component 300 is provided with a first braking part, and the sliding seat 200 is provided with a second braking part that cooperates with the first braking part. When the braking component 300 moves towards the sliding seat 200, the first braking part and the second braking part lock together, restricting the sliding of the sliding seat 200.

Figure 3:
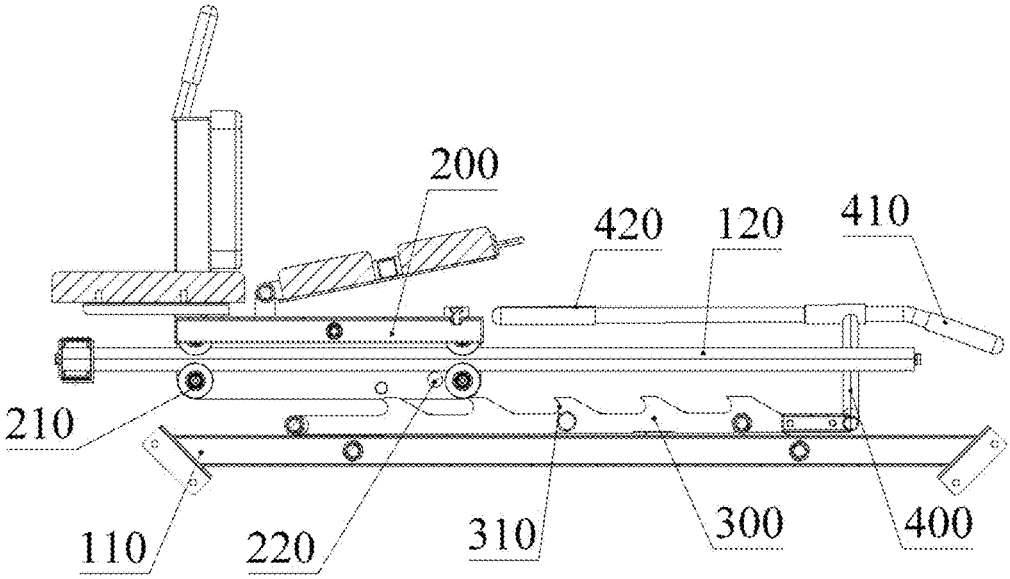
FIG. 3 is a cross-sectional view of a part of the structure of the present disclosure.
Figure 4:
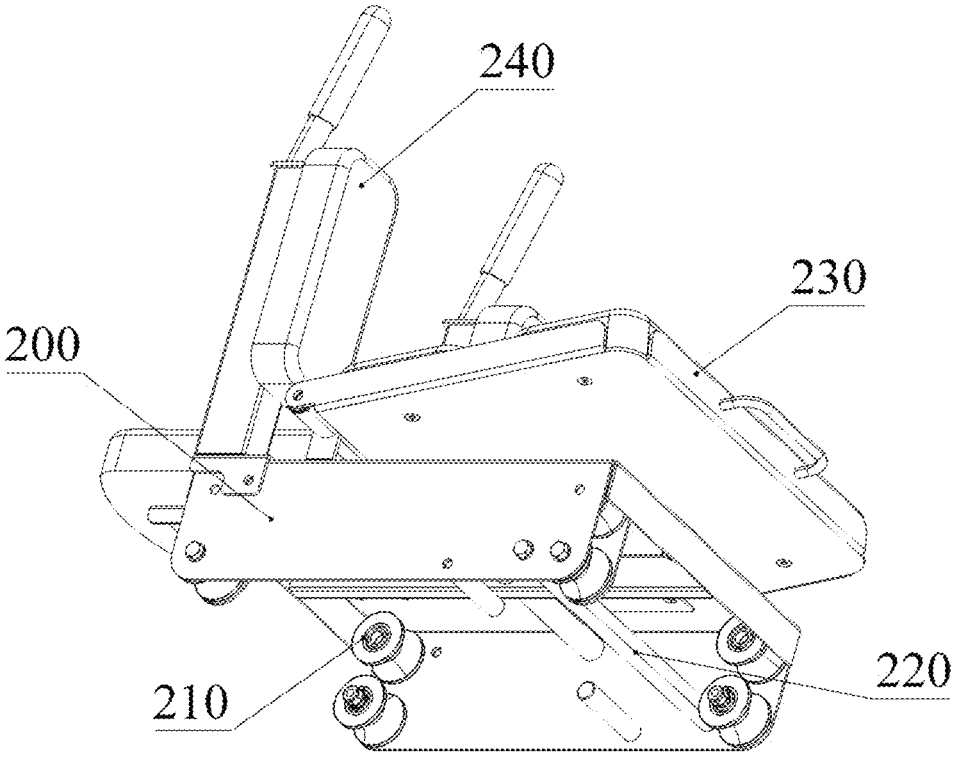
FIG. 4 is a schematic structural diagram of a moving mechanism of the present disclosure.

Please refer to FIG. 1, FIG. 3, and FIG. 4. In this embodiment, the guide rails 120 are circular and there are two of them. The two guide rails 120 are arranged parallel to each other on both sides of the rack 100. The braking component 300 is installed between the two guide rails 120, and its projection is located between the two guide rails 120 and directly below the sliding seat 200. Both sides of the bottom of the sliding seat 200, parallel to the guide rails 120, are equipped with pulley sets 210. Each pulley set 210 consists of two pulleys, with a gap between them to allow the guide rails 120 to pass through. The sliding seat 200 moves back and forth on the guide rails 120 via the pulley sets 210.

In other embodiments (not shown), the sliding seat 200 and the guide rails 120 can also achieve reciprocating motion through sliding bearings, linear bearings, or other suitable linear motion transmission devices. The rolling elements used in sliding bearings can be steel balls, rollers, or ceramic balls to adapt to different load requirements and maintain good motion accuracy and durability during long-term use. Linear bearings can provide lower friction resistance and higher load capacity, allowing the selection of the appropriate device for reciprocating motion based on actual needs.

Figure 2:
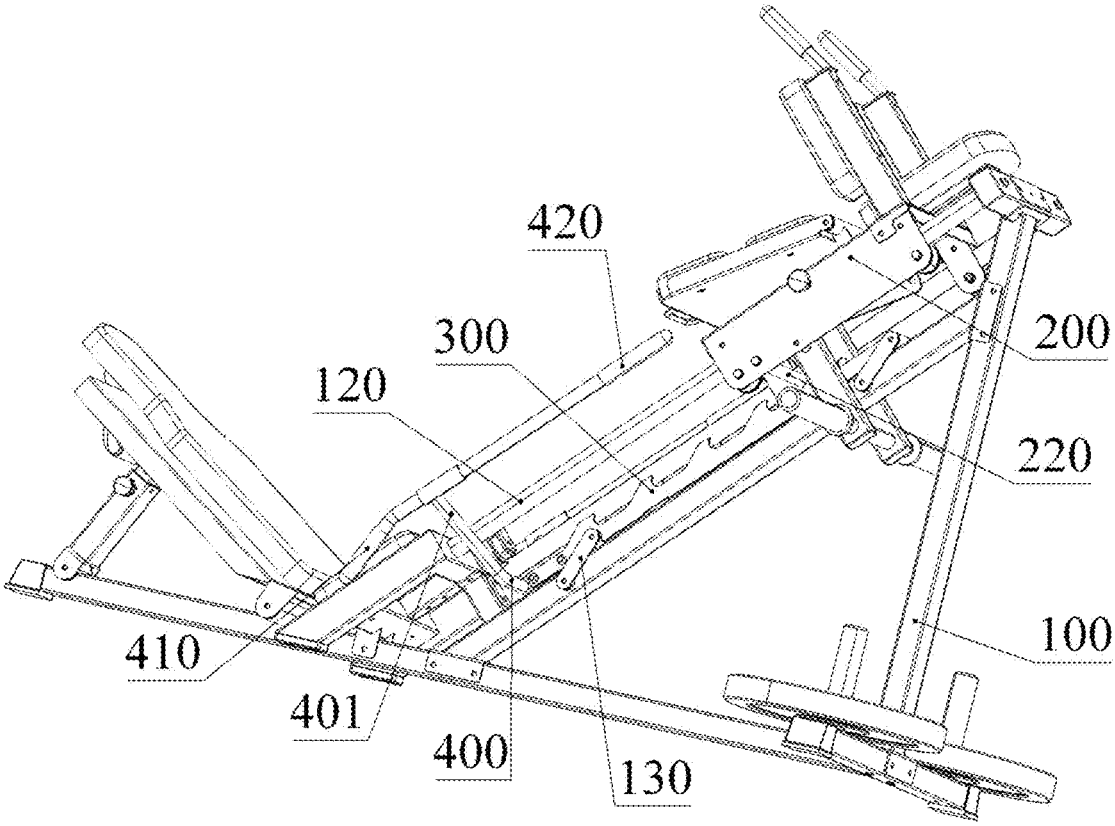
FIG. 2 is a schematic structural diagram of the present disclosure from another perspective.

Please refer to FIGS. 1 and 2. In this embodiment, the rack 100 also includes a support rod 110, a horizontal rod, and a vertically arranged upright rod. The horizontal rod and the upright rod are perpendicularly connected to each other. At the connection point of the horizontal rod and the upright rod, there is also a placement rack for placing counterweights. The placement rack is symmetrically set on both sides of the connection point and forms a T-shaped structure with the horizontal rod. The T-shaped arrangement of the horizontal rod and the placement rack enhances the stability of the rack 100, helping to resist external disturbances and vibrations, ensuring the smooth operation of the leg exercise device. The support rod 110 is set at an angle and forms a certain angle with the horizontal rod and the upright rod. One end of the support rod 110 is fixedly connected to the upright rod, and the other end is fixedly connected to the horizontal rod. The support rod 110, the horizontal rod, and the upright rod form a stable triangular structure through mutual connection; the design of the triangular structure further strengthens the stability of the rack 100. The triangular structure can effectively distribute loads from different directions, improving the overall load-bearing capacity, enabling the rack 100 to maintain excellent stability under different usage conditions, and preventing the equipment from becoming unstable or shaking during high-load or intense exercise.

In other embodiments (not shown), the support rod 110 can be designed with an adjustable angle. Multiple fixing points are set on the horizontal rod of the rack 100, allowing users to select different fixing points based on actual needs and connect the support rod 110 to them, thereby adjusting the tilt angle of the support rod. This design enables the rack 100 to flexibly adapt to various usage scenarios, allowing users to adjust the angle of the support rod according to personal preferences for optimal usage experience and comfort. Additionally, the support rod 110 can be set parallel to the horizontal rod, and the multiple configurations can meet the needs of different users or environments, enhancing the product's market competitiveness.

Figure 7:
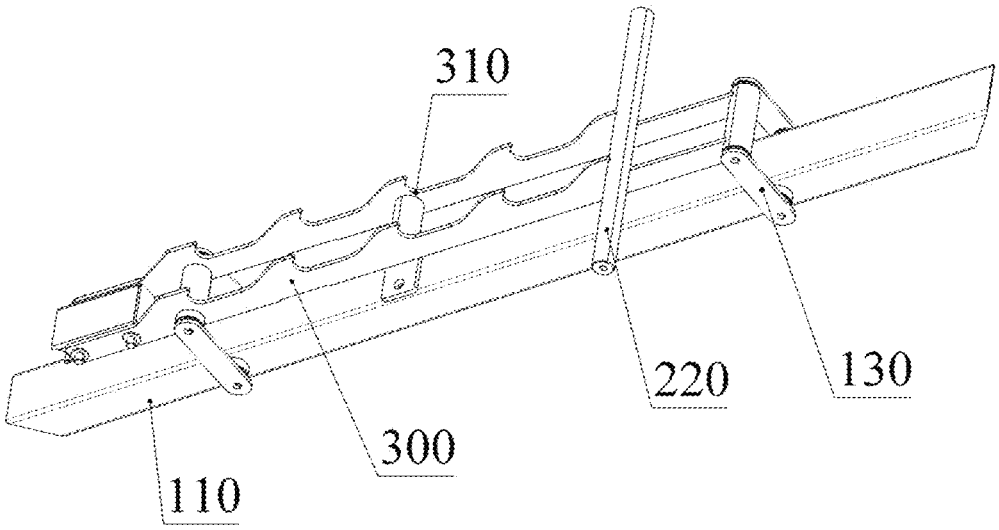
FIG. 7 is a schematic diagram of the structure when the braking component and the crossbar of the present disclosure are locked together.

Please refer to FIGS. 1, 2, and 7. In this embodiment, the rack 100 further includes a support rod 110, which is used to support and connect the braking component 300. Rockers 130 are pivotally connected between the braking component 300 and the support rod 110. The rockers 130 are pivotally connected to the braking component 300 and the support rod 110 via shafts, allowing the rockers 130 to swing between the braking component 300 and the support rod 110. When the rockers 130 swing, they can control the braking component 300 to move closer to or away from the sliding seat 200. The rocker 130 has a limited angle, and when it rotates to this angle, the braking component 300 moves closer to the sliding seat 200. The braking component 300 is a long rod and is arranged parallel to the guide rail 120 and the support rod 110. This parallel arrangement ensures that the guide rail 120 and the support rod 110 remain parallel to the braking component 300 during the reciprocating motion of the sliding seat 200. There are four rockers 130, symmetrically distributed on both sides of the braking component 300, with two rockers 130 on each side. The two rockers 130 on the same side are located at the two ends of the braking component 300 and the support rod 110, forming a corresponding configuration in pairs. This distribution ensures that the rockers 130 are evenly distributed between the braking component 300 and the support rod 110, providing balanced force during the movement of the braking component 300 and ensuring more stable and reliable swinging motion for a more balanced and stable rocking movement.

In another embodiment (not shown), the support rod 110 can be eliminated, with one end of the rocker 130 pivotally connected to the braking component 300 and the other end pivotally connected to the rack 100. This simplified design can still achieve the swinging function of the braking component 300. However, by eliminating the support rod 110, the overall complexity and weight of the device can be reduced, thereby lowering production and assembly costs.

In other embodiments (not shown), the rockers 130 can also be arranged diagonally, on a single side, or in the middle position between the braking component 300 and the rack 100. Diagonal arrangement means that the rockers 130 are placed on the diagonal sides of the braking component 300 and the support rod 110 respectively; single-side design means that the rockers 130 are only placed on one side of the braking component 300 and the support rod 110, simplifying the structure and reducing the number of components, thereby lowering manufacturing costs.

Figure 5:
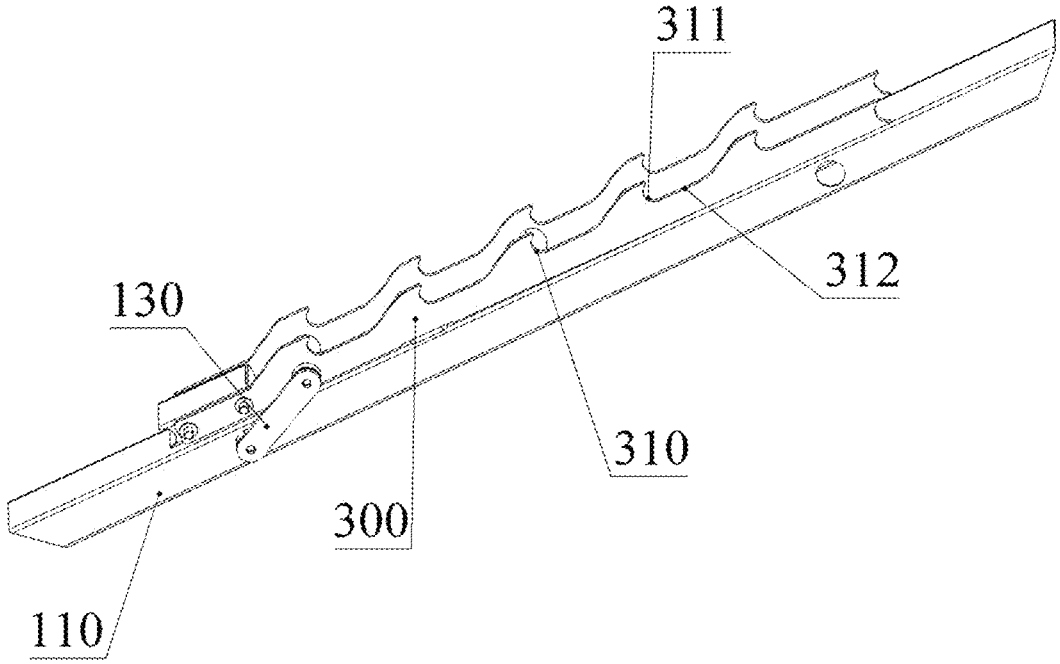
FIG. 5 is a schematic diagram of the structure of a braking component of the present disclosure.
Figure 6:
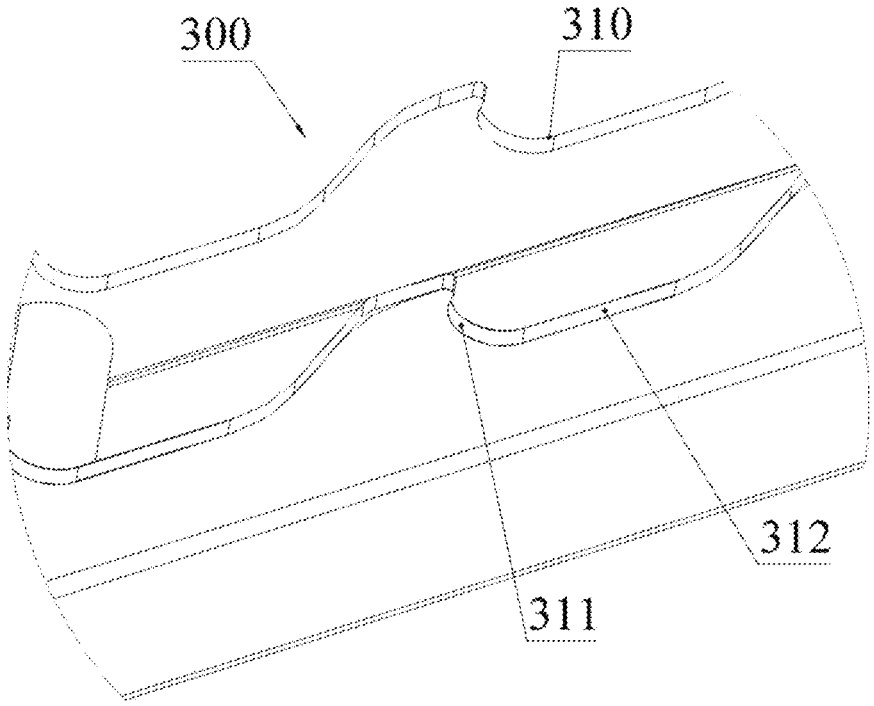
FIG. 6 is a partial enlarged view of the braking component of the present disclosure.

Please refer to FIGS. 1, 3, and 5. In this embodiment, the first braking part consists of multiple serrated grooves 310 provided on the braking component 300. The openings of the serrated grooves 310 face the direction away from the seat cushion 150 of the sliding seat 200, and the multiple serrated grooves 310 are evenly distributed along the sliding direction of the sliding seat 200. The evenly distributed serrated grooves 310 can lock the second braking part at different positions, allowing the sliding seat 200 to be locked at various positions. The second braking part is a crossbar 220 installed at the bottom of the sliding seat 200. When the sliding seat 200 is mounted on the guide rail 120, the crossbar 220 is located below the guide rail 120 and can interlock with the serrated grooves 310. The crossbar 220 is perpendicular to the braking component 300. When the braking component 300 approaches the sliding seat 200, the crossbar 220 engages with one of the serrated grooves 310 to achieve locking, effectively braking the sliding seat 200 and preventing it from further sliding. When the sliding seat 200 slides along the guide rail 120 in the direction away from the seat cushion 150, the braking component 300 moves downward in the direction perpendicular to the guide rail 120 under the influence of gravity or external force, gradually moving away from the sliding seat 200. At this point, the crossbar 220 at the bottom of the sliding seat 200 disengages from the serrated grooves 310 as the sliding seat 200 moves, placing the sliding seat 200 in an unlocked state, allowing it to perform reciprocating motion along the guide rail 120.

In another embodiment (not shown), a serrated groove 310 can be set at the bottom of the sliding seat 200, with the serrated groove 310 oriented in the opposite direction to that of the serrated groove 310 in the aforementioned embodiment, facing the direction of the seat cushion 150. Multiple crossbars 220 are evenly arranged on the braking component 300. When the braking component 300 approaches the sliding seat 200, the crossbars 220 engage into the serrated groove 310, thereby locking and securing the sliding seat 200.

In another embodiment (not shown), the first braking part can also be multiple vertical protrusions. The vertical protrusions are evenly spaced along the length of the braking component 300, and the distance between any two adjacent protrusions can accommodate the crossbar 220 to slide a certain distance within it. When the sliding seat 200 slides towards the seat cushion 150 and the braking component 300 moves towards the sliding seat 200, the crossbar 220 will come into contact with one of the vertical protrusions and form a lock, thereby preventing the sliding seat 200 from continuing to move in the current sliding direction. At this point, the sliding seat 200 is restricted to its current position and cannot continue to slide, achieving the function of emergency braking. When the sliding seat 200 slides away from the seat cushion 150, the crossbar 220 disengages from the contact with the vertical protrusion. Under the influence of gravity or external force, the braking component 300 moves downward in a direction perpendicular to the guide rails 120, gradually moving away from the sliding seat 200. The sliding seat 200 regains its free sliding state and can continue to reciprocate on the guide rails 120.

In other embodiments (not shown), the first braking part is not limited to the two implementation methods described above, and the first braking part can also take any other form suitable for the present disclosure.

Please refer to FIGS. 1, 2, 3, and 7. In this embodiment, a seat cushion 150 is also installed on the rack 100. The seat cushion 150 is positioned at one end of the guide rail 120. The sliding seat 200 has a first sliding direction and a second sliding direction, which are opposite to each other. The first sliding direction is when the sliding seat 200 slides towards the seat cushion 150, and the second sliding direction is when the sliding seat 200 slides away from the seat cushion 150. When the braking component 300 moves close to the sliding seat 200 and the sliding seat 200 slides in the first sliding direction, the crossbar 220 and the braking component 300 engage with each other, locking the sliding seat 200 in place and preventing it from sliding further in the first sliding direction. When the crossbar 220 and the braking component 300 are interlocked, sliding the sliding seat 200 in the second sliding direction causes it to gradually move away from the braking component 300, allowing the crossbar 220 to disengage from the serrated groove 310. This results in the automatic unlocking of the crossbar 220 and the braking component 300, placing the sliding seat 200 in an unlocked state where it is slidable back and forth along the guide rails 120.

Please refer to FIGS. 1, 5, 6, and 7. In this embodiment, the serrated groove 310 is oriented towards the second sliding direction of the sliding seat 200, and the serrated groove 310 is composed of a concave surface 311 facing the second sliding direction and a flat surface 312 facing the sliding seat 200. When the concave surface 311 is oriented towards the second sliding direction, the serrated groove 310 has a hook-like engagement capability, providing additional clamping force after the crossbar 220 enters the serrated groove 310. The concave surface 311, existing as a hook-shaped structure, can prevent the crossbar 220 from moving up and down or disengaging from the serrated groove 310, thereby effectively avoiding the risk of the sliding seat 200 losing its lock and becoming unlocked.

When the braking component 300 moves close to the sliding seat 200, and the sliding seat 200 slides along the first sliding direction, the rocker 130 rotates to a limited angle. The crossbar 220 first contacts the flat surface 312 of the serrated groove 310, while there is still a certain distance between the crossbar 220 and the concave surface 311 of the serrated groove 310. As the sliding seat 200 continues to slide in the first sliding direction, the crossbar 220 gradually slides into the concave surface 311 of the nearest serrated groove 310 and locks with the concave surface 311. The crossbar 220 and the braking component 300 are interlocked together, preventing the sliding seat 200 from continuing to slide in the first sliding direction. When it is necessary to unlock the sliding seat 200, the crossbar 220 and the braking component 300 are locked together. By sliding the sliding seat 200 in the second sliding direction, the crossbar 220 gradually slides out of the concave surface 311 and enters the flat surface 312. At this point, the crossbar 220 disengages from the serrated groove 310, and the crossbar 220 and the braking component 300 are unlocked. Under the influence of gravity, the braking component 300 and the rocker 130 swing back toward the rack 100, returning to the initial position to complete the unlocking. At this point, the sliding seat 200 can continue to perform reciprocating motion along the guide rail 120, restoring normal use.

Please refer to FIGS. 1 to 3. In this embodiment, the braking mechanism further includes a toggle member connected to the braking component 300. The toggle member can toggle the braking component 300 to control its movement to approach or move away from the sliding seat 200. Toggle members are installed on both sides of the braking component 300. The toggle member includes a connecting rod 400 and a first shifting rod 410. The connecting rod 400 has two ends. One end of the connecting rod 400 is connected to the braking component 300 through a bolt. The other end of the connecting rod 400 extends to the side away from the braking component 300, extends out of the guide rail 120, and is configured as an extended end 401. The first shifting rod 410 is installed on the extended end 401. The toggle member also includes a second shifting rod 420, which is installed on the extended end 401. The toggle member is installed on the braking component 300 near one end of the seat cushion 150. When the moving mechanism slides, it can approach or move away from the seat cushion 150. The first shifting rod 410 extends towards the seat cushion 150. The second shifting rod 420 extends towards the moving mechanism and is parallel to the guide rail 120. For pedaling backwards, the first shifting rod 410 and the second shifting rod 420 can be used as armrests to assist in exerting force.

In other embodiments (not shown), the toggle member can also be positioned in the middle of the braking component 300 or at the end away from the seat cushion 150, and can be set according to actual needs.

Please refer to FIGS. 8 to 11. In this embodiment, the rack 100 is pivotally connected to the first backrest 140 near the position of the seat cushion 150. The first backrest 140 can rotate within a certain range, allowing the position of the first backrest 140 to be adjusted in different usage modes. The moving mechanism is equipped with a second backrest 230, which is rotationally connected to the sliding seat 200. The end of the second backrest 230 away from the seat cushion 150 is further provided with a lifting arm 240, which has a shoulder pad. The second backrest 230 can switch between being parallel to the lifting arm 240 or perpendicular to it in different usage states. The lower part of the moving mechanism is equipped with a counterweight rod, which is used to place counterweight blocks. The counterweight rod is parallel to the crossbar 220 and located below the braking component 300.

Figure 8:
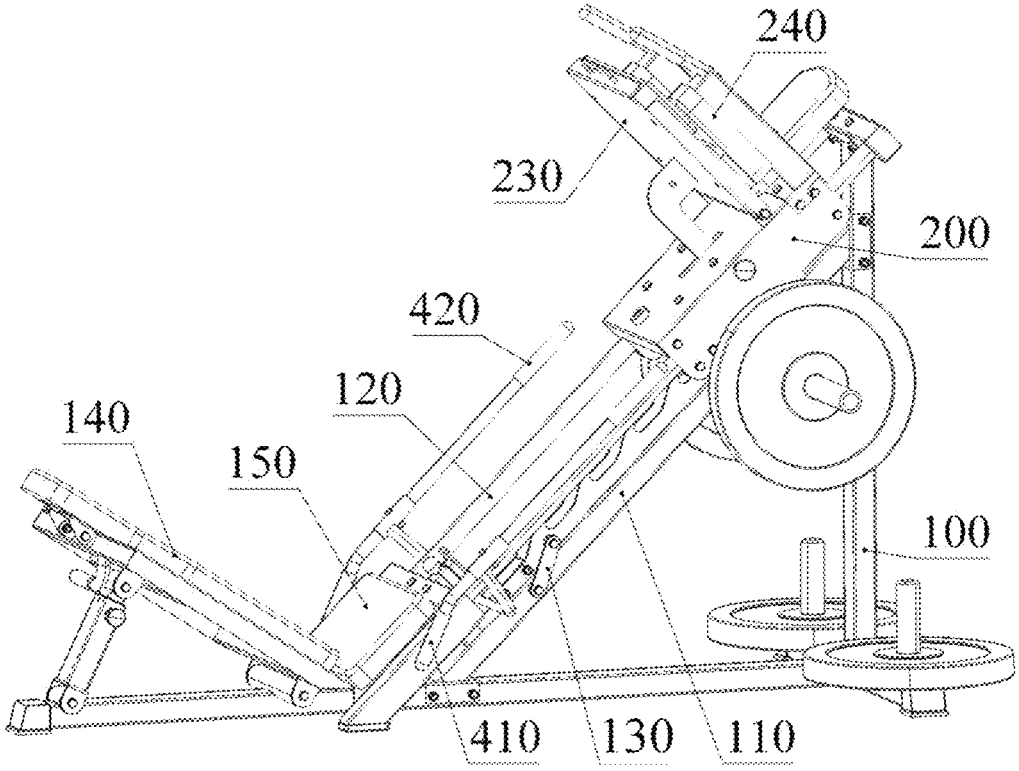
FIG. 8 is a schematic diagram of the structure of a reverse-pedaling moving mechanism of the present disclosure away from the seat cushion.
Figure 9:
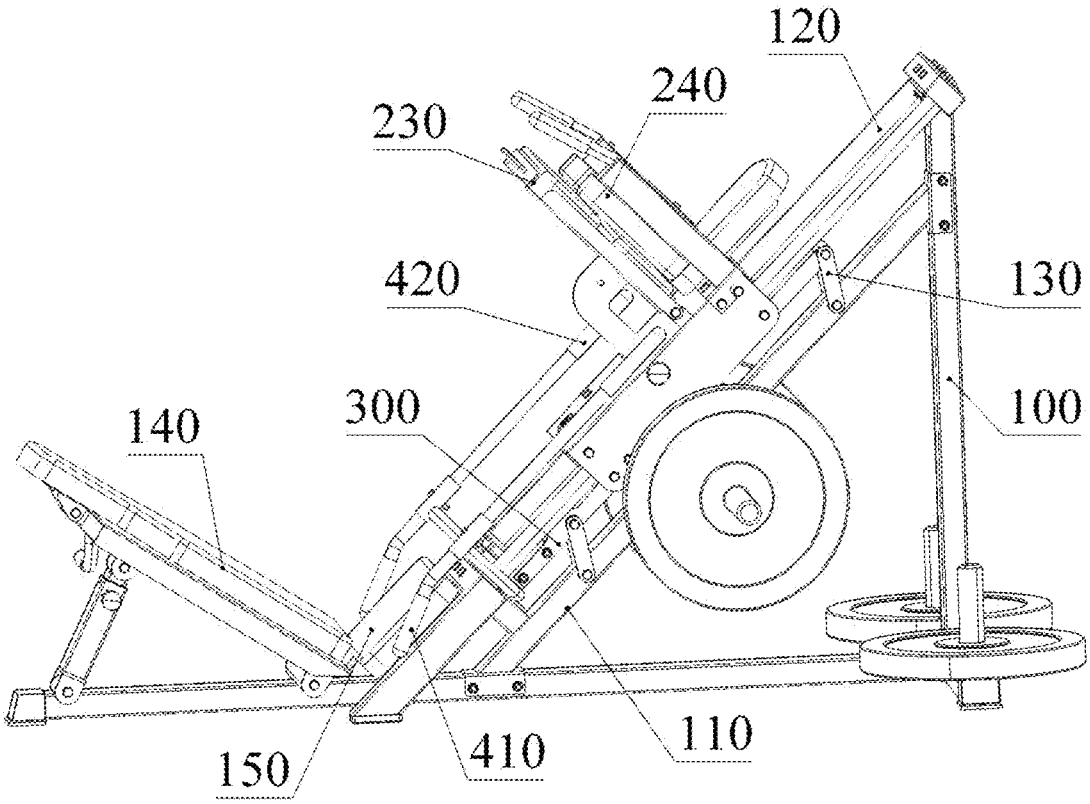
FIG. 9 is a schematic diagram of the structure of the reverse-pedaling moving mechanism of the present disclosure close to the seat cushion.

Please refer to FIGS. 8 to 11. The present disclosure has two exercise modes: reverse pedaling and forward pedaling. During reverse pedaling, the second backrest 230 is flipped to a state parallel and attached to the lifting arm 240. The user sits on the seat cushion 150 with his back against the first backrest 140, and his feet push against the flipped second backrest 230 to control the sliding of the sliding seat 200. The first shifting rod 410 and the second shifting rod 420 can be used as armrests to assist in exerting force. Additionally, by moving the first shifting rod 410, the braking component 300 is driven to lock with the sliding seat 200, as shown in FIGS. 8 and 9.

Figure 10:
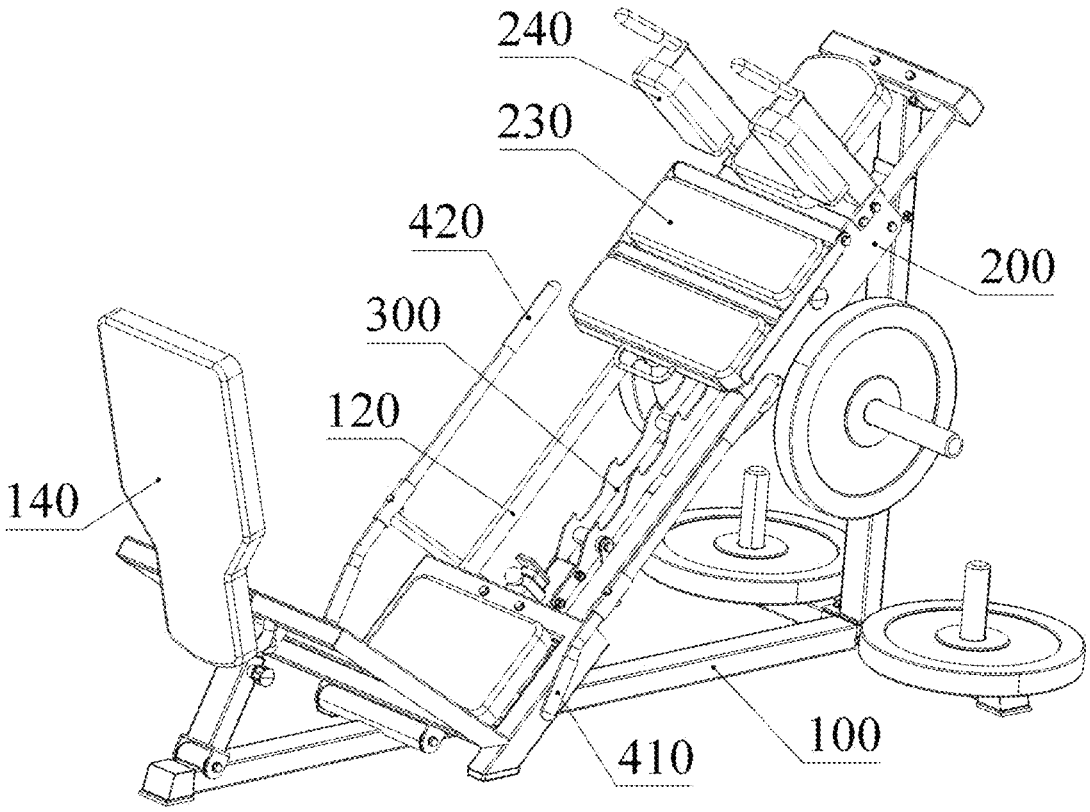
FIG. 10 is a schematic diagram of the structure of a forward-pedaling moving mechanism of the present disclosure close to the seat cushion.
Figure 11:
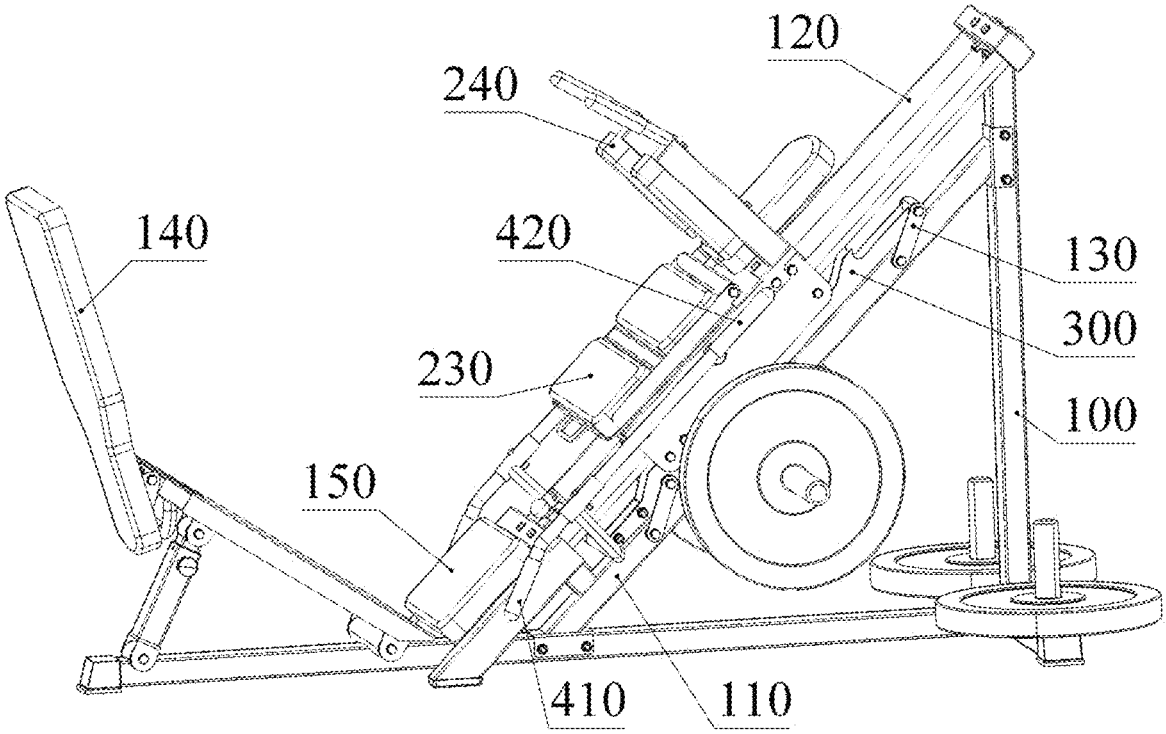
FIG. 11 is a schematic structural diagram of the forward-pedaling moving mechanism of the present disclosure away from the seat cushion.

For forward pedaling exercise, the first backrest 140 is flipped upward, the second backrest 230 and the lifting arm 240 are vertically positioned to ensure that the user's back is in contact with the second backrest 230. The upper shoulder abuts against the shoulder pad, and the feet are placed at the position of the rack 100 where the first backrest 140 is installed. Then, by toggling the second shifting rod 420, the braking component 300 is driven to be locked with the sliding seat 200, as shown in FIGS. 10 and 11.

In summary, it can be seen from the above description that the present disclosure achieves the following technical effects: multiple serrated grooves 310 are provided on the braking component 300, and the sliding of the sliding seat 200 is restricted by the locking of the crossbar 220 with the serrated grooves 310; the evenly distributed serrated grooves 310 allow the sliding seat 200 to be locked at different positions, the braking component 300 is controlled by a toggle member, and when emergency braking is required, only the toggle member needs to be toggled to control the braking component 300 to lock the sliding seat 200; when unlocking is required, it only needs to slide the sliding seat 200 in the second sliding direction to achieve automatic unlocking; the emergency braking function ensures that users can immediately stop the exercise when encountering an emergency during exercise, making users more at ease when performing leg exercises, thereby improving the continuity and effectiveness of the exercise.

In the description of the present disclosure, it should be appreciated that directional terms such as "front, rear, up, down, left, right", "horizontal, vertical, perpendicular, horizontal" and "top, bottom" etc. indicate the orientation or positional relationship based on the orientation or positional relationship shown in the drawings, and are only for the convenience of describing the present disclosure and simplifying the description. In the absence of a contrary explanation, these directional terms do not indicate or imply that the device or element referred to must have a specific orientation or be constructed and operated in a specific orientation, and therefore should not be understood as limiting the scope of protection of the present disclosure; the directional terms "inside, outside" refer to the inside and outside relative to the contour of each component itself.

For the convenience of description, spatial relative terms such as "on . . . ", "above . . . ", "on the upper surface of . . . ", "upper" etc. may be used here to describe the spatial positional relationship of a device or feature with other devices or features as shown in the drawings. It should be appreciated that spatial relative terms are intended to encompass different orientations of the device in use or operation other than the orientation described in the drawings. For example, if the device in the drawing is inverted, the device described as "above other devices or structures" or "on other devices or structures" will subsequently be positioned as "below other devices or structures" or "under other devices or structures". Thus, the exemplary term "above" can include both "above" and "below" orientations. The device can also be positioned in other different ways (rotated 90 degrees or in other orientations), and the spatial relative descriptions used here should be interpreted accordingly.

In addition, it should be noted that the use of terms such as "first", "second" etc. to define components is for the convenience of distinguishing the corresponding components. Unless otherwise stated, the above terms have no special meaning, and therefore should not be understood as limiting the scope of protection of the present disclosure.

The above description is only a preferred embodiment of the present disclosure and is not intended to limit the present disclosure. For those skilled in the art, the present disclosure can have various modifications and changes. Any modifications, equivalent replacements, improvements etc. made within the spirit and principles of the present disclosure should be included within the scope of protection of the present disclosure.

What is claimed is:

1. A leg exercise device with emergency braking, comprising a rack and a moving mechanism, wherein the rack is equipped with guide rails, and the moving mechanism is slidable back and forth along the guide rails; and the moving mechanism comprises a sliding seat, which is slidably connected to the guide rails and is slidable along the guide rails; and the rack is further provided with a braking mechanism located on one side of the sliding seat, wherein the braking mechanism comprises a braking component that is movable towards the sliding seat, and the braking component extends along a sliding direction of the sliding seat; and the braking component is equipped with a first braking part, and the sliding seat is equipped with a second braking part that cooperates with the first braking part; and when the braking component moves towards the sliding seat, the first braking part locks with the second braking part, restricting sliding of the sliding seat; and wherein rockers are pivotally connected between the braking component and the rack, allowing the rockers to swing between the braking component and the rack, and when the rockers swing, the braking component moves closer to or away from the sliding seat.

2. The leg exercise device with emergency braking according to claim 1, wherein the first braking part is a plurality of serrated grooves provided on the braking component, and the plurality of serrated grooves are evenly distributed along the sliding direction of the sliding seat.

3. The leg exercise device with emergency braking according to claim 2, wherein the second braking part is a crossbar arranged on the sliding seat, and the crossbar is arranged perpendicular to the braking component.

4. The leg exercise device with emergency braking according to claim 3, wherein the sliding seat has a first sliding direction and a second sliding direction, wherein when the braking component moves close to the sliding seat and the sliding seat slides along the first sliding direction, the crossbar and the braking component are mutually locked; and when the crossbar and the braking component are mutually locked, the sliding seat slides along the second sliding direction, and the crossbar and the braking component automatically unlock.

5. The leg exercise device with emergency braking according to claim 4, wherein the plurality of serrated grooves are oriented towards the second sliding direction of the sliding seat.

6. The leg exercise device with emergency braking according to claim 5, wherein each of the plurality of serrated grooves comprise a concave surface oriented towards the second sliding direction; and when the braking component moves close to the sliding seat, and the sliding seat slides along the first sliding direction, the crossbar locks with a corresponding one of the concave surfaces and the crossbar and the braking component lock with each other; and when the crossbar and the braking component lock with each other, and the sliding seat slides along the second sliding direction, the crossbar disengages from the corresponding concave surface, and the crossbar and the braking component unlock.

7. The leg exercise device with emergency braking according to claim 3, wherein when the braking component moves close to the sliding seat, the crossbar is able to engage into one of the plurality of serrated grooves and achieve locking; and when the braking component moves away from the sliding seat, the crossbar disengages from the locking with the serrated groove.

8. The leg exercise device with emergency braking according to claim 1, wherein the rack further comprises a support rod, and the rocker is pivotally connected between the support rod and the braking component.

9. The leg exercise device with emergency braking according to claim 8, wherein the braking component, the guide rails, and the support rod are arranged parallel to each other, and the rockers are arranged at two ends of the braking component and the support rod.

10. The leg exercise device with emergency braking according to claim 1, wherein the first braking part comprises a plurality of protrusions, which protrude at intervals on one side of the braking component along the sliding direction of the sliding seat.

11. A leg exercise device with emergency braking, comprising a rack and a moving mechanism, wherein the rack is equipped with guide rails, and the moving mechanism is slidable back and forth along the guide rails; and the moving mechanism comprises a sliding seat, which is slidably connected to the guide rails and is slidable along the guide rails; and the rack is further provided with a braking mechanism located on one side of the sliding seat, and the braking mechanism comprises a braking component and rockers; and the braking component extends along a sliding direction of the sliding seat, and the rockers are pivotally connected between the rack and the braking component, allowing the rockers to swing between the braking component and the rack; and when the rockers swing, the braking component moves closer to or away from the sliding seat; and the braking component and the sliding seat are respectively equipped with a first braking part and a second braking part; and when the braking component moves towards the sliding seat, the first braking part and the second braking part lock together, restricting sliding of the sliding seat.

12. The leg exercise device with emergency braking according to claim 11, wherein the first braking part comprises a plurality of protrusions, which protrude at intervals on one side of the braking component along the sliding direction of the sliding seat.

13. The leg exercise device with emergency braking according to claim 12, wherein when the braking component moves close to the sliding seat, the second braking part abuts against one of the plurality of protrusions, thereby achieving braking of the sliding seat; and when the braking component moves away from the sliding seat, the second braking part disengages from the one of the plurality of protrusions for releasing braking of the sliding seat.

14. The leg exercise device with emergency braking according to claim 11, wherein the first braking part is a plurality of serrated grooves provided on the braking component, and the plurality of serrated grooves are evenly distributed along the sliding direction of the sliding seat; and the second braking part is a crossbar installed at a bottom of the sliding seat, and the crossbar is arranged perpendicular to the braking component.

15. The leg exercise device with emergency braking according to claim 14, wherein the sliding seat has a first sliding direction and a second sliding direction, wherein when the braking component moves close to the sliding seat and the sliding seat slides along the first sliding direction, the crossbar and the braking component are mutually locked; and when the crossbar and the braking component are mutually locked, the sliding seat slides along the second sliding direction, and the crossbar and the braking component automatically unlock.

16. A leg exercise device with emergency braking, comprising a rack and a moving mechanism, wherein the rack is equipped with guide rails, and the moving mechanism is slidable back and forth along the guide rails; and the moving mechanism comprises a sliding seat, which is slidably connected to the guide rails and is slidable along the guide rails; and the rack is further provided with a braking mechanism located on one side of the sliding seat, wherein the braking mechanism comprises a braking component that is movable towards the sliding seat, and the braking component extends along a sliding direction of the sliding seat; and the braking component and the sliding seat are respectively provided with a first braking part and a second braking part; and the braking mechanism further comprises a toggle member, and the toggle member is toggled to drive the braking component to move towards the sliding seat; and when the braking component moves towards the sliding seat, the first braking part and the second braking part lock together, restricting sliding of the sliding seat;

wherein rockers are pivotally connected between the braking component and the rack, allowing the rockers to swing between the braking component and the rack; and when the rockers swing, the braking component moves closer to or away from the sliding seat.

17. The leg exercise device with emergency braking according to claim 16, wherein when swinging towards the sliding seat, the rockers drive the braking component to move closer to the sliding seat, and the first braking part and the second braking part lock together; and when the first braking part disengages from the second braking part, the rockers and the braking component swing back to the rack under the influence of gravity.

18. The leg exercise device with emergency braking according to claim 16, wherein the guide rails are two guide rails, which are arranged on two sides of the rack; and a projection of the braking component is located between the two guide rails, and the two guide rails are parallel to each other.

* * * * *